US006453139B2

(12) United States Patent
Sasame et al.

(10) Patent No.: US 6,453,139 B2
(45) Date of Patent: Sep. 17, 2002

(54) IMAGE FORMING APPARATUS

(75) Inventors: Hiroshi Sasame; Hiroaki Ogata; Yasunari Watanabe; Shinya Yamamoto; Motoki Adachi, all of Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/758,286

(22) Filed: Jan. 12, 2001

(30) Foreign Application Priority Data

Jan. 18, 2000 (JP) ..... 2000-008959
Jan. 18, 2000 (JP) ..... 2000-008960

(51) Int. Cl.[7] ..... G03G 15/00; G03G 15/16; G03G 15/01

(52) U.S. Cl. ..... 399/167; 399/66; 399/82; 399/299

(58) Field of Search ..... 399/66, 82, 167, 399/297, 298, 299, 300, 302, 303

(56) References Cited

U.S. PATENT DOCUMENTS 5,153,651 A * 10/1992 Kurotaka ..... 399/82
5,272,506 A 12/1993 Goto et al.
5,463,450 A 10/1995 Inoue et al.
5,515,154 A * 5/1996 Hasegawa et al. ..... 399/303
5,565,975 A * 10/1996 Kumon et al. ..... 399/302
6,108,510 A * 8/2000 Nakane ..... 399/303
6,148,163 A * 11/2000 Ito ..... 399/82 X
6,185,387 B1 * 2/2001 Ohzeki et al. ..... 399/66
6,324,358 B1 * 11/2001 Sahara ..... 399/66

* cited by examiner

*Primary Examiner*—Sandra Brase
(74) *Attorney, Agent, or Firm*—Fitzpatrick, Cella, Harper & Scinto

(57) ABSTRACT

In an image forming apparatus adapted to form images by employing a plurality of image bearing members, when a monocolor mode is selected, no toner image is formed on photosensitive drums of the colors other than the photosensitive drum on which a black toner image is formed. However, the photosensitive drums of the remaining colors continue to run while maintaining a speed difference in a four-full-color mode in relation to an intermediary transfer belt. As a result, some photosensitive drums reach their service life even if the toners contained in developing devices have not yet run out or even if images have not yet been formed on a predetermined number of transfer materials. To solve the problem, the peripheral speed of each of the photosensitive drums in the black monocolor mode for producing monochrome images is set to be faster than that in the full-color mode so as to make the peripheral speed virtually equal to the moving speed of the intermediary transfer belt.

37 Claims, 6 Drawing Sheets

IMAGE FORMING APPARATUS

BACKGROUND OF THE INVENTION

1. Field of the Invention

The present invention relates to an image forming apparatus that employs an electrophotographic system and, more particularly to, an image forming apparatus of a copying machine, a printer, a facsimile machine, or the like.

2. Description of the Related Art

A variety of color image forming apparatuses that utilize an electrophotographic recording system to form color images on transfer materials have been devised, and some of them have become commercially practical.

One of the aforesaid typical image forming apparatuses includes a rotary developing unit equipped with developing devices for four colors, e.g., yellow, magenta, cyan, and black, that contain toners as the developers of these colors and are disposed in a developing order in relation to photosensitive members serving as image bearing members. The electrostatic latent images of the different colors, which have been formed on the same single photosensitive member, are turned into visible toner images by the respective developing devices at a predetermined developing position. Each toner image is transferred onto a transfer medium or a transfer material, such as paper, borne and conveyed by a transfer belt or the like functioning as a transfer material conveying member. This series of steps is repeated to form a multicolor toner image.

There has been proposed another type of apparatus in which different color toner images are selectively superimposed in sequence on a photosensitive member thereby to form or develop a multicolor toner image on the photosensitive member, then the multicolor toner image is transferred all at once onto a transfer medium.

There is still another image forming apparatus employing an "inline system" in which different color toner images are formed on a plurality of photosensitive members by developing devices for the different colors, and the different color toner images on the photosensitive members are sequentially and superimposedly transferred onto a transfer material conveyed by a transfer belt or the like working as a transfer material conveying member, thereby producing a multicolor toner image. Furthermore, there is an intermediary transfer type image forming apparatus. In this type of apparatus, a toner image is not directly transferred onto a transfer material from each photosensitive member; instead, the different color toner images are sequentially and superimposedly transferred onto an intermediary transfer member serving as a transfer medium, then the multicolor toner image on the intermediary transfer member is transferred onto a transfer material all at once.

Each of these typical systems of the color image forming apparatuses employing the electrophotographic recording method described above has its merits and demerits. The inline system is more advantageous than others in the aspect of meeting the recent market demand for higher speed, while the intermediary transfer system is more advantageous than others in that it is capable of handling a wider variety of transfer materials, including cardboard.

Referring now to the schematic sectional view shown in FIG. 6, a conventional example of an inline type color image forming apparatus will be described.

As shown in FIG. 6, photosensitive drums 1*a* through 1*d* disposed so that they respectively oppose developing means 4*a* through 4*d,* such as developing devices, containing different color toners are arranged in a direction in which an intermediary transfer belt 6 moves. The different color toner images that have been formed on the photosensitive drums 1*a* through 1*d* by the developing means 4*a* through 4*d* undergo a first transfer process in which the toner images are electrostatically superimposed on the intermediary transfer belt 6 in succession by transferring rollers 8*a* through 8*d* to form a full-color toner image composed of toners of four colors, namely, yellow, magenta, cyan, and black. Then, in a second transfer process, the full-color toner image is transferred onto a transfer material P from the intermediary transfer belt 6 all at once, and heated and pressurized onto the transfer material P by a fixing device (not shown), thereby turning into a permanent image.

Furthermore, charging means 2*a* through 2*d,* exposing means 3*a* through 3*d,* and developing means 4*a* through 4*d* for forming different color toner images on the photosensitive drums are disposed around the photosensitive drums 1*a* through 1*d.*

There are also provided cleaning devices 5*a* through 5*d* having cleaning blades that frictionally slides off the residual toners remaining on the photosensitive drums to collect them after transferring the different color toner images onto the intermediary transfer belt 6.

An operation for forming an image will now be described. The exposing means 3*a* through 3*d* apply laser beams that have been modulated based on image data received from a host, such as a personal computer, to the surfaces of the photosensitive drums 1*a* through 1*d* that have been uniformly charged by charging rollers, which correspond to the charging means 2*a* through 2*d,* thereby forming desired electrostatic latent images of the different colors. The latent images are inversely developed at the developing positions by the developing means 4*a* through 4*d* into visible toner images, the developing means 4*a* through 4*d* being the developing devices that contain the toners for the different colors and are disposed facing against the photosensitive drums. The toner images are then transferred in succession onto the intermediary transfer belt 6 at the transfer positions, and simultaneously transferred onto the transfer material P that is fed with predetermined timings by a feeding means (not shown) and conveyed by a conveying means. The color toner image on the transfer material P is heated and melted by the fixing device (not shown) so as to be permanently fixed on the transfer material, thus providing a desired color print image.

Hitherto, there has been proposed a method in which the peripheral speeds of the photosensitive drums and the peripheral speed of the intermediary transfer belt at the transfer positions are set different from each other in order to improve the efficiency of transfer of toner images from the photosensitive drums onto the intermediary transfer belt. This will improve the transfer efficiency of different color toner images, making it extremely advantageous for superimposedly transferring toner images of two or more colors. Especially in a full-color mode involving four colors, the provision of the speed difference between the photosensitive drums and the intermediary transfer belt enables a good image with a uniform hue to be achieved by improving the transfer efficiency by preventing a "hollow image" problem in which a toner image that has been transferred from a photosensitive drum to the intermediary transfer belt misses its internal image section.

The foregoing color image forming apparatus is adapted to allow selection between the full-color mode for forming full-color toner images using the toners of the four colors and a monocolor mode (monochrome mode) whereby only a photosensitive drum for a black toner is used to form a monochrome image.

The image forming apparatus, however, has been presenting the following problem in the monocolor mode.

In the monocolor mode wherein only the black toner is used to produce a monochrome image, no toner images are formed on the photosensitive drums of the colors other than the photosensitive drum on which a black toner image is formed. However, the photosensitive drums for the remaining colors continue to run with the aforesaid speed difference maintained in the four-full-color mode in relation to the intermediary transfer belt 6. This means that the photosensitive drums of the remaining colors wastefully slide against the cleaning blades and the intermediary transfer belt 6, leading to wear or scratches. As a result, there have been some cases where the photosensitive drums reach their service life even if the toners contained in the developing devices have not yet run out or even if images have not yet been formed on a predetermined number of transfer materials.

A possible solution to the above problem is, for example, to space the intermediary transfer belt 6 apart from the photosensitive drums for the remaining colors, as necessary, in the monocolor mode. This, however, would give rise to a problem in that a separating device for spacing the intermediary transfer belt 6 away from the photosensitive drums of the remaining colors is required, resulting in extremely high cost or an increased size of the apparatus.

SUMMARY OF THE INVENTION

Accordingly, it is an object of the present invention to provide an image forming apparatus capable of preventing the service life of an image bearing member from expiring sooner than expected, without requiring an increase in size, complication in design, or increased cost of the apparatus.

Further objects, features and advantages of the present invention will become apparent from the following description of the preferred embodiments (with reference to the attached drawings).

DESCRIPTION OF THE PREFERRED EMBODIMENTS (First Embodiment)

An embodiment according to the present invention will now be described in conjunction with the accompanying drawings.

Figure 1:
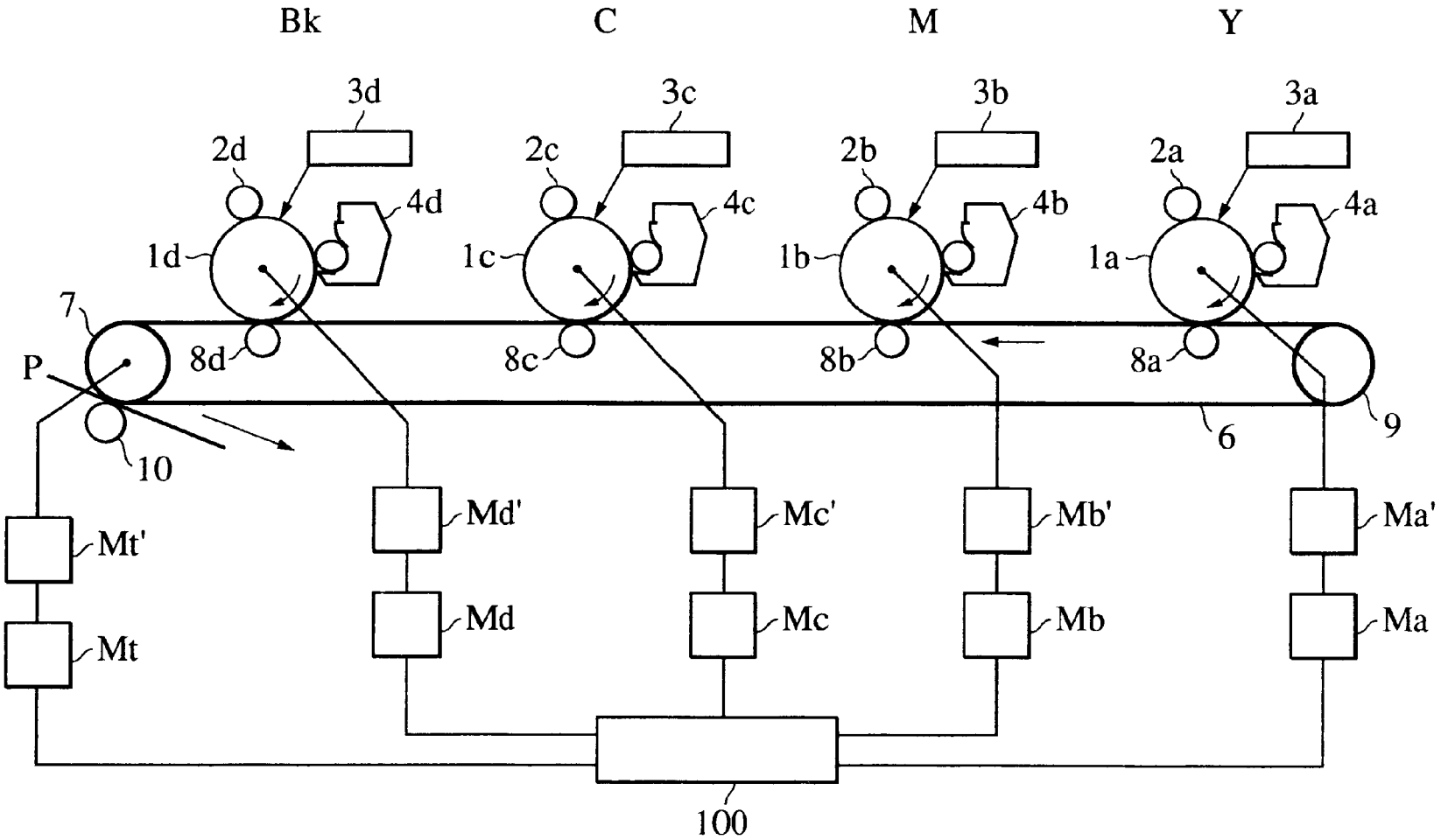
FIG. 1 is a block diagram of an image forming apparatus employing an intermediary transfer belt according to the present invention.
Figure 6:
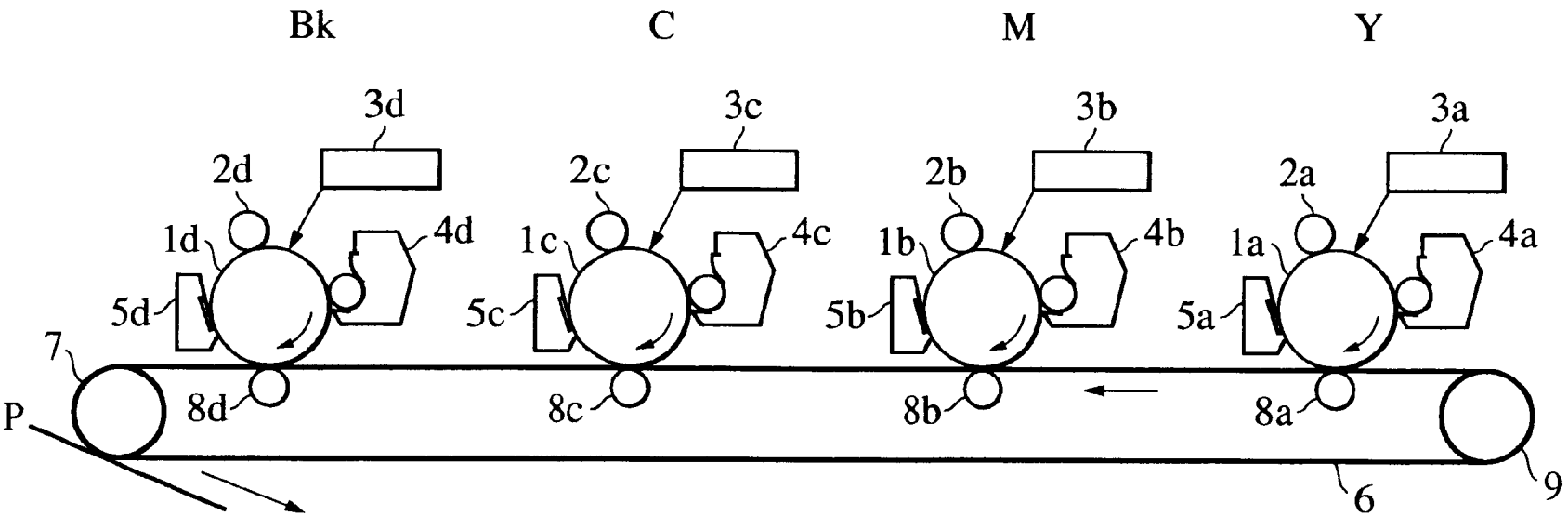
FIG. 6 is a block diagram showing an image forming apparatus employing a conventional intermediary transfer belt.

FIG. 1 is a block diagram illustrating an inline type color image forming apparatus in accordance with the present invention. Like reference numerals will be assigned to the components having the same functions as those of the components of the image forming apparatus of FIG. 6 described above as the conventional example.

Referring to FIG. 1, developing means 4*a* through 4*d* formed of developing devices or the like contain yellow (Y), magenta (M), cyan (C), and black (Bk) toners having negative electric properties. Photosensitive drums 1*a* through 1*d,* which are image bearing members and disposed so that they respectively oppose the developing means 4*a* through 4*d,* are arranged in a direction in which an intermediary transfer belt 6 as a transfer medium or an intermediary transfer member moves.

Furthermore, charging means 2*a* through 2*d* for charging by abutting against the photosensitive drums under a predetermined level of pressure, exposing means 3*a* through 3*d,* and the developing means 4*a* through 4*d* are disposed around the photosensitive drums 1*a* through 1*d* to form different color toner images on the photosensitive drums 1*a* through 1*d.*

The apparatus employs a system in which, after transferring toner images from the photosensitive drums onto the intermediary transfer belt 6, the residual toners remaining on the photosensitive drums are charged by the charging means, and the charged remaining toners are electrostatically collected back to the developing devices at developing positions, thus obviating the need for a separately provided cleaner. This arrangement prevents the apparatus from becoming larger and complicated. Moreover, the image forming apparatus is adapted to electrostatically attach or develop electrostatic latent images formed on photosensitive drums by the toners at the developing positions while electrostatically collect charged remaining toners back to the developing devices at the developing positions at the same time when successively forming images on a plurality of transfer materials. This arrangement permits higher throughput of image formation to be achieved.

The endless intermediary transfer belt 6 is installed on a driving roller 7 and a driven roller 9, and rotates in the direction indicated by the arrow drawn in the belt loop in the diagram.

An image forming operation will now be described. The exposing means 3*a* through 3*d* apply laser beams that have been modulated based on image data received from a host, such as a personal computer, to the surfaces of the photosensitive drums 1*a* through 1*d* that have been uniformly charged to negative polarity by charging rollers, which correspond to the charging means 2*a* through 2*d,* thereby forming desired electrostatic latent images of different colors. The latent images are inversely developed at the developing positions by the developing means 4*a* through 4*d* into visible toner images, the developing means 4*a* through 4*d* being the developing devices that are disposed opposing the latent images and contain different color toners. The toner images on the photosensitive drums undergo a primary transfer process wherein they are electrostatically superimposed in succession on the intermediary transfer belt 6 at transfer positions by primary transfer rollers 8*a* through 8*d.* The superimposed toner images further undergo a secondary transfer process wherein they are electrostatically transferred all at once by a secondary transfer roller 10 onto a transfer material P, namely, transfer paper, that is fed with predetermined timings by a feeding means (not shown) from a paper feed cassette and conveyed by a conveying means.

The color toner image on the transfer material P is heated and melted by the fixing device (not shown) to be permanently fixed on the transfer material P, thus providing a desired color print image.

The primary transfer rollers are adapted to press the intermediary transfer belt toward the photosensitive drums with a predetermined level of pressure.

In this embodiment, a speed difference is provided between the peripheral speed of each of the photosensitive drums and the peripheral speed of the intermediary transfer belt at each of the transfer positions in order to improve the efficiency of transferring toner images from the photosensitive drums onto the intermediary transfer belt. With this arrangement, the efficiency of the primary transfer of the different color toner images from the photosensitive drums onto the intermediary transfer belt can be improved, making it extremely advantageous especially when superimposedly transferring toner images of two or more colors from the photosensitive drums onto the intermediary transfer belt. This arrangement makes it possible to suppress variations in a hue caused by deterioration of transfer efficiency.

Furthermore, the image forming apparatus according to this embodiment is adapted to allow selection between the full-color mode for forming full-color toner images using the toners of the four colors or the photosensitive drums for the four colors and a monocolor mode wherein only a black toner or a photosensitive drum for the black toner is used to form a monochrome image. The selection between the two modes is performed by a control means, namely, a CPU 100, according to original image information or a mode specified by a user.

Figure 2:
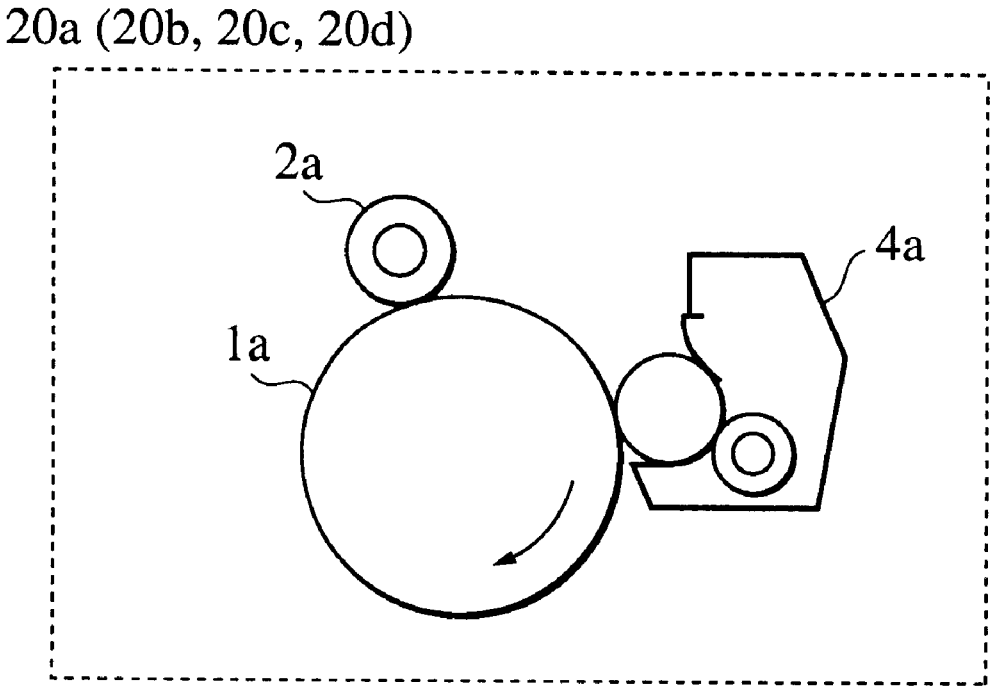
FIG. 2 is a block diagram showing a process cartridge.

Referring to FIG. 2, the photosensitive drums 1*a* through 1*d,* the charging means 2*a* through 2*d,* and the developing means 4*a* through 4*d* are respectively formed into four discrete units, namely, process cartridges 20*a* through 20*d,* that can be detachably installed to the main body of the apparatus.

In this embodiment, driving motors Ma through Md serving as the drive sources for rotatively driving the photosensitive drums 1*a* through 1*d* are provided, so that the peripheral speed of each of the photosensitive drums can be independently controlled by the CPU. The driving forces produced by the motors Ma through Md are transmitted to rotating shafts secured or fitted to the photosensitive drums via drive transmitting means Ma' through Md', such as gears. Alternatively, the driving forces produced by the motors Ma through Md may be transmitted directly to the rotating shafts secured or fitted to the photosensitive drums without the intermediary of the drive transmitting means Ma' through Md'.

The driving force of a driving motor Mt serving as a drive source is transmitted to the driving roller 7 via a drive transmitting means Mt', such as a gear. The rotative driving force is transmitted to the intermediary transfer belt by the driving roller 7. Alternatively, the driving force of the driving motor Mt may be transmitted directly to the driving roller 7 without the intermediary of the drive transmitting means Mt', such as a gear.

In the embodiment, the photosensitive drums are constantly held in contact with the intermediary transfer belt under a predetermined level of pressure. Alternatively, however, the photosensitive drums may be held in contact with the intermediary transfer belt under a predetermined level of pressure at least during the formation of an image. When attaching or detaching a process cartridge or when installing or removing the intermediary transfer belt unit to or from the main body of the apparatus, a user may manually separate the photosensitive drums from the intermediary transfer belt so as to prevent a slide scratch caused by slide friction between the photosensitive drums and the intermediary transfer belt during the installation or removal.

Detailed descriptions will now be given of a case where the full-color mode is selected. When the full-color mode is selected, it is preferable to provide the peripheral speed of the intermediary transfer belt 6 with a difference of 0.5% to 3.5% from the peripheral speeds of the photosensitive drums 1*a* through 1*d* at the transfer positions where the primary transfer of toner images of yellow, magenta, cyan, and black is carried out. In this embodiment, a 1.5% difference in peripheral speed is provided, the peripheral speed of the intermediary transfer belt 6 being higher than the peripheral speeds of the photosensitive drums. The same advantages will be obtained if the peripheral speeds of the photosensitive drums are set to be higher than the peripheral speed of the intermediary transfer belt 6.

More specifically, when the peripheral speed of each of the photosensitive drums at each of the transfer positions is denoted by V1, and the peripheral speed of the intermediary transfer belt at each of the transfer positions is denoted by V2, the following relationship preferably holds true:

$$0.5<\{(V1-V2)/V2\}\times 100<3.5$$

or $$0.5<\{(V2-V1)/V1\}\times 100<3.5$$

Setting the peripheral speeds of the photosensitive drums 1*a* through 1*d* and the intermediary transfer belt as shown above makes it possible to suppress variations in a hue caused by deterioration of transfer efficiency, thus allowing good full-color images to be accomplished.

Descriptions will now be given of a case where a monocolor mode for forming monochrome images is selected.

When the monocolor mode is selected, the peripheral speeds of the photosensitive drums 1*a* through 1*d* at the transfer positions are changed from those in the full-color mode. In this embodiment, the peripheral speeds of the photosensitive drums 1*a* through 1*d* are controlled by the CPU so that they are higher than in the full-color mode, and approximately equal to the peripheral speed of the intermediary transfer belt 6 at the transfer positions. The peripheral speed of the intermediary transfer belt is set to the same speed in both modes.

Completely equal speed, however, is impossible to realize; therefore, if a difference in peripheral speed is smaller than 0.3%, then it is referred to as "equal speed" in this embodiment. More specifically, when the peripheral speeds of the photosensitive drums 1*a* through 1*d* at the transfer positions are denoted by V3, and the peripheral speed of the intermediary transfer belt 6 at the transfer positions is denoted by V4, and if the following relation holds true, then damage to the photosensitive drums attributable to the difference in peripheral speed relative to the intermediary transfer belt has practically been prevented:

$$\{(V3-V4)/V4\}\times 100<0.3$$

or $$\{(V4-V3)/V3\}\times 100<0.3$$

In a mode, such as the full-color mode, wherein toner images of two or more colors are superimposedly transferred onto an intermediary transfer belt, deterioration of the efficiency of transferring toner images to be transferred onto the intermediary transfer belt from photosensitive drums leads to variations in the hue of an image. For this reason, it is necessary to provide a difference between the peripheral speeds of the photosensitive drums and the peripheral speed of the intermediary transfer belt. In the mode wherein toner images of only a single black color are transferred onto the intermediary transfer belt, no superimposition of toner images for producing a color image is involved. Hence, no variations in a hue will show in a resulting image, so that there is no need to provide such a peripheral speed difference between the photosensitive drum for black and the intermediary transfer belt.

Figure 3:
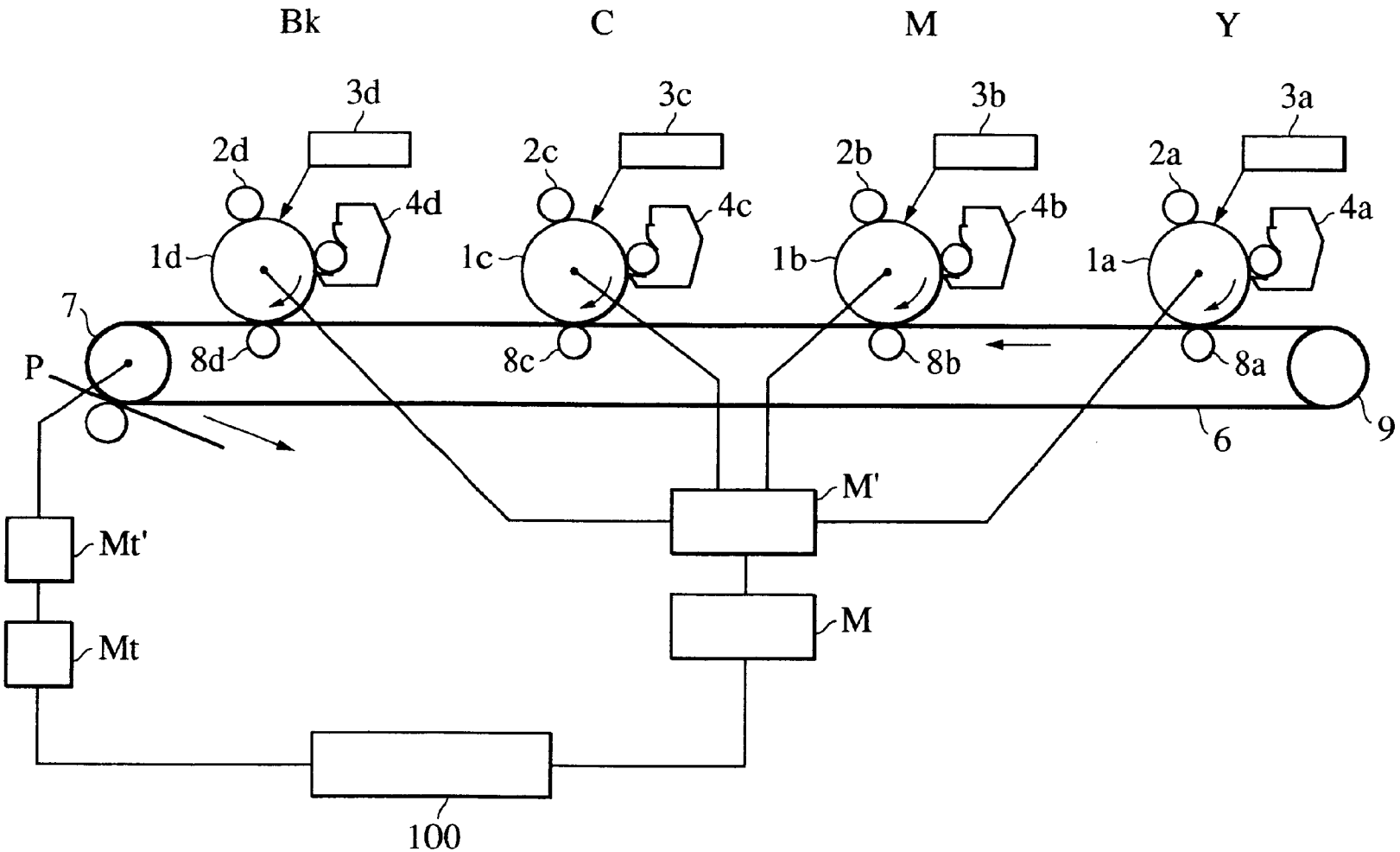
FIG. 3 is another block diagram showing the image forming apparatus employing the intermediary transfer belt according to the present invention.

With the aforesaid arrangement, the number of the driving motors for rotatively driving the photosensitive drums can be reduced to one, as shown in FIG. 3. This eventually reduces the load on the CPU controlling the revolution of a driving motor M, so that a simpler construction, a reduced size, and lower cost of the apparatus can be achieved. Reference character M' represents a drive transmitting means, such as a gear.

The length in the vertical scanning direction of a toner image formed on a photosensitive drum may be adjusted in advance by the CPU 100 according to an image forming mode, that is, a peripheral speed difference, in order to prevent an image formed on the transfer material P from expanding or shrinking due to the difference provided between the peripheral speeds of the photosensitive drums and the peripheral speed of the intermediary transfer belt. With this arrangement, images faithful to original images can be formed on the transfer materials P whether the set mode is the full-color mode or the monocolor mode.

The image forming apparatus according to this embodiment, in particular, employs the system without any separate cleaner for the photosensitive drums, as in the conventional example, so that the photosensitive drums do not incur damage caused by a cleaning blade. Hence, the service lives of the photosensitive drums heavily depend on scraping or scratching caused by slide friction between the photosensitive drums and the intermediary transfer belt. This problem, however, has been solved by the present invention.

In the black monocolor mode for forming monochrome images, since only the photosensitive drum for black is used and there is no need to form any color images by superimposedly transferring toners, the peripheral speeds of the photosensitive drum for black and the intermediary transfer belt may be set higher than in the full-color mode. This will enable improved throughput of image formation when forming images in succession on a plurality of transfer materials. The foregoing peripheral speed relationship between the intermediary transfer belt and the photosensitive drums also holds true in this case.

In the embodiment, the following method has been adopted to verify that there is a difference between the peripheral speed of each of the photosensitive drums and the intermediary transfer belt at each of the transfer positions.

First, predetermined test toner images are formed on a photosensitive drum. For instance, two line toner images that extend in the horizontal scanning direction are formed on the photosensitive drums in the vertical scanning direction with a predetermined distance provided therebetween. Before transferring the test toner images onto the intermediary transfer belt, a distance A (corresponding to the above predetermined distance) between the two line toner images in the rotational direction of the photosensitive drum (in the vertical direction) is measured. Then, after the test toner images have undergone the primary transfer onto the intermediary transfer belt, a distance B between the two line toner images on the intermediary transfer belt in the direction in which the intermediary transfer belt moves is measured prior to the secondary transfer onto a transfer material.

For measuring the distances A and B, a 18 mm-wide transparent polyester tape No. 550 (#25) made by Nichiban was used.

To be more specific, to measure distance A, the test toner images on the photosensitive drum prior to the primary transfer is adhesively transferred onto the tape, and the tape is attached to predetermined paper (e.g. graduated paper) to measure distance A between the test toner images. The same applies to distance B. After completion of the primary transfer of the test toner images onto the intermediary transfer belt, the toner images are adhesively transferred onto the tape before the secondary transfer, and the tape is attached to the predetermined paper to measure distance B between the test toner images.

Lastly, based on the measured distances A and B, the difference between the peripheral speed of the photosensitive drum and the peripheral speed of the intermediary transfer belt at the transfer position can be determined.

There is another method available in which laser beams or a laser doppler meter is used to measure the moving speed of a photosensitive drum and the moving speed of the intermediary transfer belt at a primary transfer nip.

The measurement methods are not limited to those described above. Other appropriate methods may be used.

The descriptions have been given of the case where black toner images are formed in the monocolor mode; however, the same applies to the monocolor mode of another color, namely, yellow, magenta, or cyan.

In the black monocolor mode, the CPU conducts control so that the difference between the peripheral speed of each of the photosensitive drums 1*a* through 1*d* and the peripheral speed of the intermediary transfer belt 6 at the transfer positions is practically reduced to zero; the present invention, however, is not limited thereto.

More specifically, if the difference between the peripheral speeds of the photosensitive drums 1*a* through 1*d* and the peripheral speed of the intermediary transfer belt at the transfer positions in the black monocolor mode is set to be smaller than the difference between the peripheral speeds of the photosensitive drums 1*a* through 1*d* and the peripheral speed of the intermediary transfer belt at the transfer positions in the four-color, full-color mode, then unwanted deterioration of the service life of the photosensitive drums can be suppressed, as described above.

Most preferably, the difference between the peripheral speeds of the photosensitive drums and the peripheral speed of the intermediary transfer belt in the black monocolor mode is reduced to zero to prevent the photosensitive drums and the intermediary transfer belt from frictionally sliding or wearing.

In this embodiment, the peripheral speed or moving speed of the photosensitive drums 1*a* through 1*d* is set to the same value regardless of the image forming mode. With this arrangement, all the photosensitive drums evenly deteriorate in service life due to the frictional sliding motion against the intermediary transfer belt. This prevents a problem in which any particular one photosensitive drum deteriorates much sooner than the remaining photosensitive drums.

(Second Embodiment)

Figure 4:
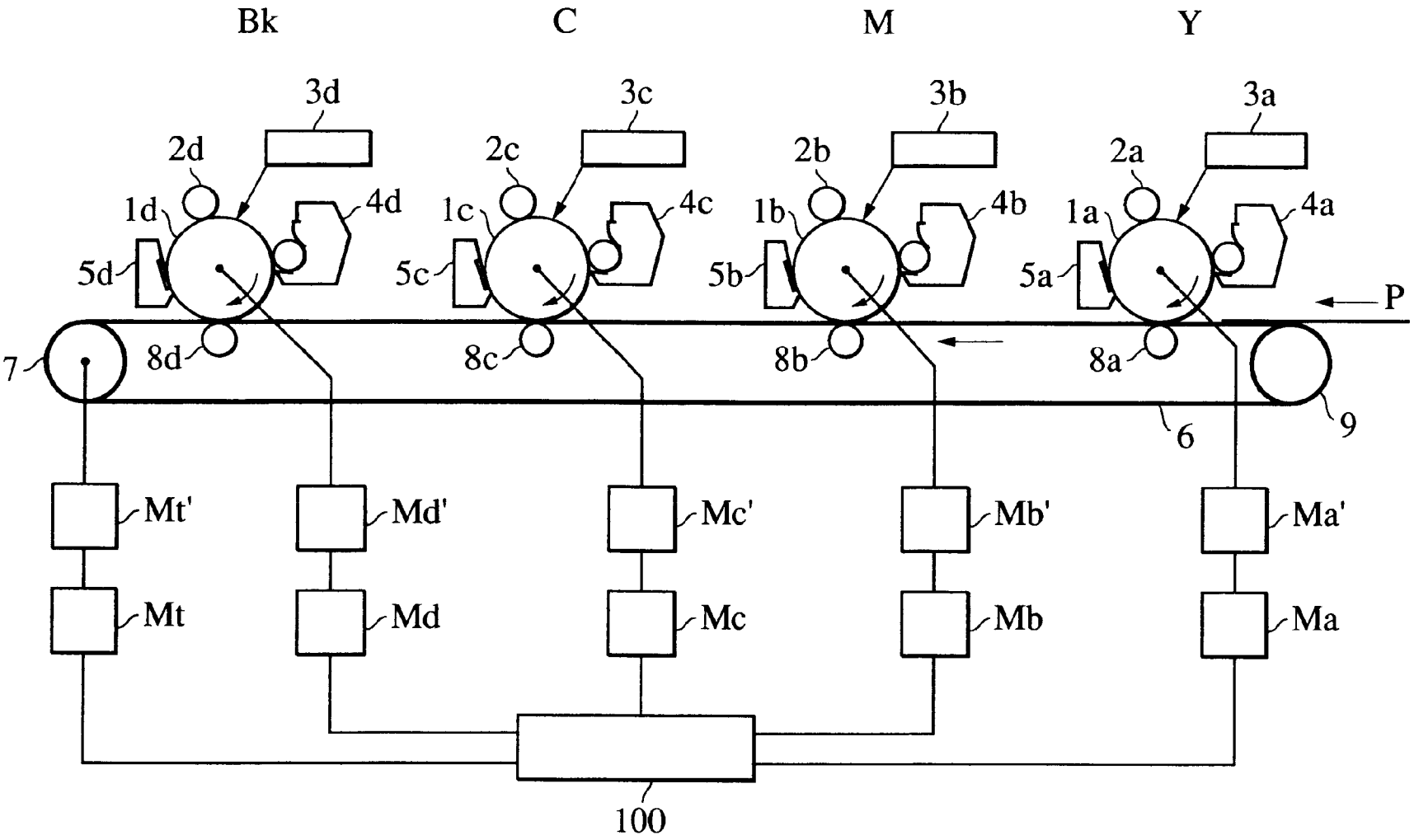
FIG. 4 is a block diagram showing another image forming apparatus employing the transfer belt according to the present invention.
Figure 5:
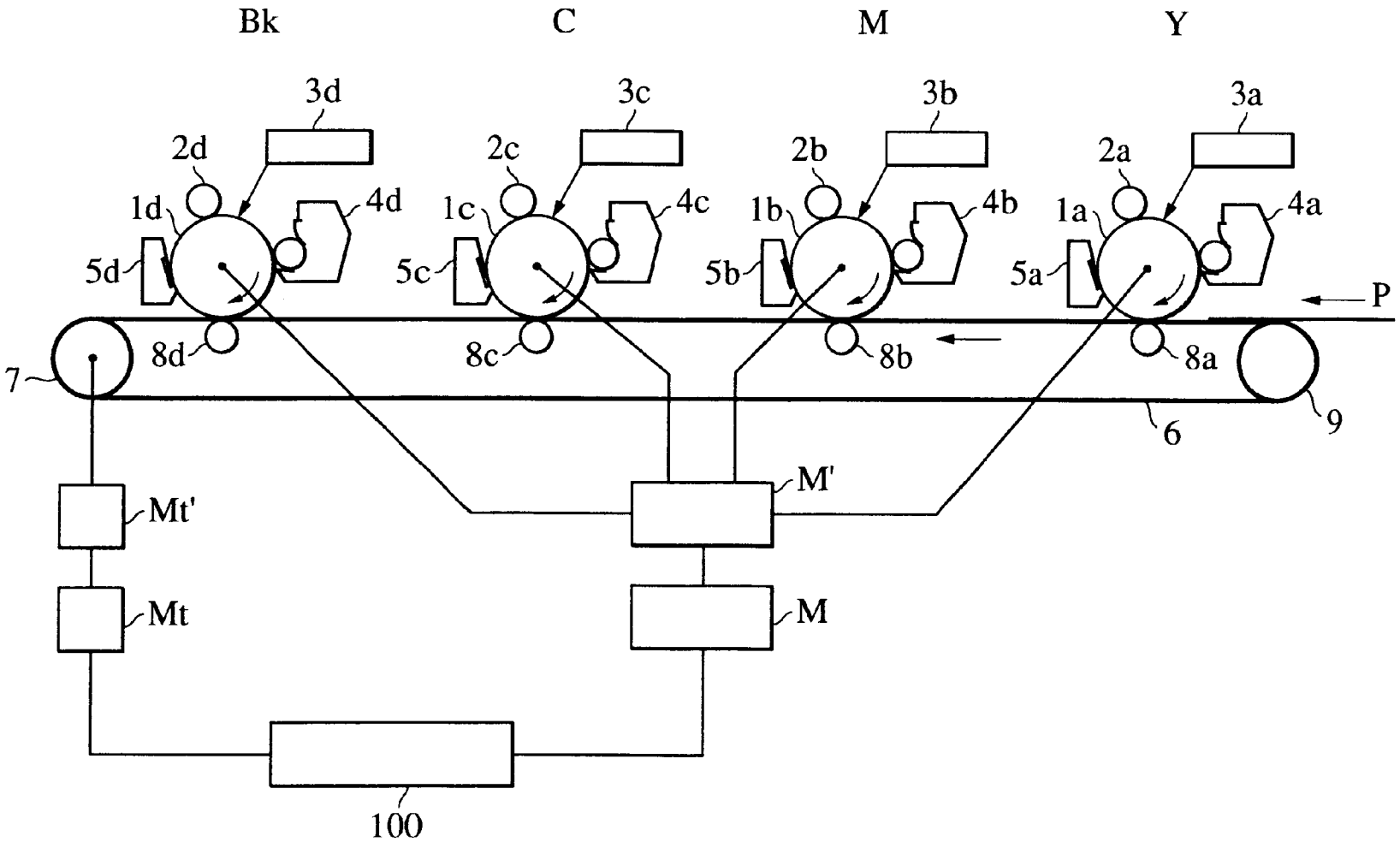
FIG. 5 is a block diagram showing still another image forming apparatus employing the transfer belt according to the present invention.

In the first embodiment, the descriptions have been given of the type of image forming apparatus adapted to first transfer a toner image onto an intermediary transfer member as a transfer medium in the primary transfer process, then further transfer the image onto a transfer material in the secondary transfer process. The descriptions will now be given of an image forming apparatus according to this embodiment that is adapted to directly transfer, in a multiplex manner, a toner image from each photosensitive drum onto a transfer material as a transfer medium conveyed by a transfer belt, as shown in FIG. 4.

The present invention can be applied also to the second embodiment, as in the case of the first embodiment, to obtain the same operation and advantage by replacing the peripheral speed of the intermediary transfer belt in the first embodiment by the peripheral speed of the transfer belt in the second embodiment, that is, the conveying speed of a transfer material P as a transfer medium conveyed by a transfer belt as a transfer material conveying member.

A section of this embodiment that is different from the image forming apparatus shown in FIG. 1 will be described in conjunction with FIG. 4. Components having like functions as those shown in FIG. 1 will be assigned like reference numerals, and the descriptions thereof will be omitted.

Photosensitive drums 1*a* through 1*d* are arranged along a transfer belt 6. The transfer belt 6 wound around a driving roller 7 and a tension roller 9 in a tensioned state bears a transfer material P thereon and conveys it to transfer positions. The moving speed of the transfer material borne by the transfer belt is identical to the moving speed of the transfer belt. Furthermore, cleaning devices 5*a* through 5*d* equipped with cleaning blades for cleaning the photosensitive drums by scraping off the toners remaining on the photosensitive drums are provided. The cleaning blades abut against the photosensitive drums in a direction counter to the moving direction of the photosensitive drums.

An image forming process will be briefly described. The different color toner images formed on the photosensitive drums 1*a* through 1*d* are fed with a predetermined timing, and electrostatically and superimposedly transferred onto the transfer material P in succession at transfer positions, the transfer material P being borne and conveyed by the transfer belt 6. This is performed by applying a predetermined positive voltage to transfer rollers 8*a* through 8*d*. The transfer rollers 8*a* through 8*d* also function to press, together with the transfer belt, the transfer material P so that the transfer material P is brought into contact with the photosensitive drums 1*a* through 1*d* at a predetermined level of pressure.

The different color toner images that have been transferred onto the transfer material P are fixed to the transfer material P by being heated and pressed by a fixing device (not shown) into permanent images.

In this embodiment also, the peripheral speed of each photosensitive drum is controlled by a control means (CPU) 100 according to an image forming mode. More specifically, in a four-color, full-color mode, a desired peripheral speed difference specified in the first embodiment is provided between the photosensitive drums and a transfer belt (and a transfer material). In a monocolor mode, the peripheral speed difference between the photosensitive drums and the transfer belt (and the transfer material) is set to be smaller than in the four-color, full-color mode, preferably set to zero. This makes it possible to prevent the service life of the photosensitive drums from expiring sooner than expected due to slide friction between the photosensitive drums and the transfer belt (and the transfer material).

The present invention is especially useful in the market because there are numerous cases where the black monocolor mode for producing monochrome images is selected in addition to the full-color mode.

Moreover, even in the system provided with the cleaning device for the photosensitive drums, as in the case of this embodiment, the possibilities of slide friction scratches on the photosensitive drums caused by the transfer belt 6 can be markedly reduced, as in the case of the first embodiment.

(Third Embodiment)

Another embodiment in accordance with the present invention will now be described in conjunction with FIG. 1.

In the third embodiment, when the full-color mode is selected, the peripheral speeds of photosensitive drums and an intermediary transfer belt are set, as in the case of the first embodiment.

In the black monocolor mode for forming monochrome images, a photosensitive drum id for black is provided with a peripheral speed difference, as in the full-color mode, while the peripheral speed of photosensitive drums 1*a* through 1*c* for yellow, magenta, and cyan, respectively, is set to a different value from that in the full-color mode. In the third embodiment, the peripheral speed of each of the photosensitive drums 1*a* through 1*c* is controlled by a CPU so that it is faster than that in the full-color mode and becomes practically identical to the moving speed of an intermediary transfer belt 6 at a transfer position. Completely equal speed, however, is impossible to realize; therefore, if a difference in peripheral speed is 0.3% or less, then it is referred to as "equal speed" in this embodiment. More specifically, when the peripheral speed of each of the photosensitive drums 1*a* through 1*c* at each of the transfer positions is denoted by V3, and the peripheral speed of the intermediary transfer belt 6 at each of the transfer positions is denoted by V4, and if the relationship shown below holds true, then damage to the photosensitive drums 1*a* through 1*c* attributable to the difference in peripheral speed relative to the intermediary transfer belt has practically been prevented. Moreover, the efficiency of transferring black toner images from the photosensitive drum 1*d* onto the intermediary transfer belt in the monocolor mode could be maintained as high as that in the full-color mode:

$$\{(V3-V4)/V4\}\times 100<0.3$$

or $$\{(V4-V3)/V3\}\times 100<0.3$$

In the black monocolor mode for producing monochrome images wherein there is no need to perform good color superimposition, the peripheral speeds of the photosensitive drum 1*d* and the intermediary transfer belt may be set to be faster than in the full-color mode. In this case, the above relationship holds true between the peripheral speed of the intermediary transfer belt and each of the peripheral speeds of the photosensitive drums.

In this embodiment, the descriptions have been given of the black monocolor mode; the present invention, however, can be also applied to a two-color or three-color mode. For instance, in a two-color mode using cyan and magenta, the same advantage can be obtained by setting the peripheral speed difference between the photosensitive drums for cyan and magenta, respectively, and the intermediary transfer belt to about 1.5%, and by setting the peripheral speed difference between the photosensitive drums for yellow and black, respectively, and the intermediary transfer belt to 0.3% or less. In other words, the configuration of the third embodiment enables high transfer efficiency to be maintained and variations in a hue to be suppressed whether the mode is set to the two-color mode or the three-color mode.

(Fourth Embodiment)

In the third embodiment, the descriptions have been given of the image forming apparatus adapted to temporarily transfer toner images from the photosensitive drums onto the intermediary transfer member. In a fourth embodiment, the descriptions will be given of an image forming apparatus adapted to directly transfer toner images from the photosensitive drums as shown in FIG. 4 onto a transfer material borne and conveyed by a transfer belt.

The present invention can be also applied to the fourth embodiment, as in the third embodiment, to obtain the operations and advantages of the present invention by replacing the peripheral speed of the intermediary transfer belt in the third embodiment by the peripheral speed of the transfer belt in this embodiment, that is, the conveying speed of a transfer material P as a transfer medium borne and conveyed by the transfer belt.

In the fourth embodiment also, the peripheral speeds of the photosensitive drums are controlled by a control means (CPU) 100 according to an image forming mode. More specifically, in a single-color mode, a two-color mode, or a three-color mode, the desired peripheral speed difference specified in the third embodiment is provided between a photosensitive drum on which an image is formed and a transfer belt or a transfer material, while virtually no peripheral speed difference is provided between the photosensitive drums on which no images are formed and the transfer belt (the transfer material). This arrangement makes it possible to prevent the service life of the photosensitive drums from expiring sooner than expected due to slide friction between the photosensitive drums and the transfer belt (and the transfer material).

The present invention is especially useful in the market because there are numerous cases where the black monocolor mode for producing monochrome images is selected in addition to the full-color mode. Hence, the service life of the photosensitive drums for yellow, magenta, and cyan, respectively, can be prolonged.

Moreover, even in the system provided with the cleaning device for the photosensitive drums, as in this embodiment, undue deterioration of durability of the photosensitive drums caused by the transfer belt 6 or the cleaning blades can be significantly suppressed, as in the case of the third embodiment.

Thus, the present invention makes it possible to prevent the service life of an image bearing member from expiring sooner than expected, without requiring an increase in size, complication in design, or increased cost of an image forming apparatus.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

a plurality of image bearing members bearing toner images of a plurality of colors, each of said image bearing members contacting a transfer medium at least during the formation of an image, wherein selection can be made between a first mode wherein the toner images are sequentially and superimposedly transferred from said image bearing members onto said transfer medium at transfer positions, and a second mode wherein a toner image of a single color is transferred from a predetermined image bearing member among said plurality of image bearing members onto said transfer medium, and wherein a difference between a moving speed of each of said image bearing members and a moving speed of said transfer medium at each of said transfer positions is smaller in said second mode than in said first mode.

2. An image forming apparatus according to claim 1, wherein the moving speed of said transfer medium is higher in said second mode than in said first mode.

3. An image forming apparatus according to claim 1, wherein the moving speed of each of said image bearing members is substantially the same as the moving speed of said transfer medium in said second mode.

4. An image forming apparatus according to claim 1, wherein said image bearing members bear a yellow toner image, a cyan toner image, a magenta toner image, and a black toner image, respectively.

5. An image forming apparatus according to claim 4, wherein a toner image of said single color is a black toner image.

6. An image forming apparatus according to claim 1, further comprising a single driving source for driving said image bearing members.

7. An image forming apparatus according to claim 1, wherein, if said second mode is selected and when the moving speed of each of said image bearing members at each of said transfer positions is denoted by V1, and the moving speed of said transfer medium at each of said transfer positions is denoted by V2, then a relationship shown below holds true:

$$|(V1-V2)/V2|\times 100<0.3.$$

8. An image forming apparatus according to claim 1, wherein, if said first mode is selected and when the moving speed of each of said image bearing members at each of said transfer positions is denoted by V3, and the moving speed of said transfer medium at each of said transfer positions is denoted by V4, then a relationship shown below holds true:

$$0.5<|(V3-V4)/V4|\times 100<3.5.$$

9. An image forming apparatus according to claim 1, further comprising a plurality of pressure applying members that press said transfer medium toward said image bearing members from a counter side to a side, where a toner image is transferred onto said transfer medium, in order to transfer a toner image on each of said image bearing members onto said transfer medium.

10. An image forming apparatus according to claim 9, wherein a voltage is applied to each of said pressure applying members when an image is transferred.

11. An image forming apparatus according to claim 1, comprising a plurality of units that include said image bearing members and are detachably installed on the main body of said image forming apparatus.

12. An image forming apparatus according to any one of claims 1 to 11, wherein said transfer medium is a transfer material borne and conveyed by a transfer material bearing member.

13. An image forming apparatus according to any one of claims 1 to 11, wherein the toner image that has been transferred onto said transfer medium is transferred to a transfer material.

14. An image forming apparatus comprising:

a plurality of image bearing members bearing toner images of a plurality of colors, said image bearing members being brought into contact with a transfer medium at least during the formation of an image, wherein selection can be made between a first mode wherein the toner images of a plurality of colors are sequentially and superimposedly transferred from said image bearing members onto said transfer medium, and a second mode wherein a toner image of a predetermined color is transferred onto said transfer medium only from a predetermined image bearing member among said plurality of image bearing members, and wherein when said second mode is selected, a moving speed of said predetermined image bearing member is different from a moving speed of said transfer medium at a position where the toner image is transferred from said predetermined image bearing member onto said transfer medium, while a moving speed of an image bearing member other than said predetermined image bearing member is substantially equal to the moving speed of said transfer medium at a position where a toner image is transferred onto said transfer medium from the image bearing member other than said predetermined image bearing member.

15. An image forming apparatus according to claim 14, wherein, when said first mode is selected, the moving speed of each of said image bearing members is different from the moving speed of said transfer medium at each of transfer positions where each of toner images is transferred from each of said image bearing members onto said transfer medium.

16. An image forming apparatus according to claim 15, wherein the moving speed of said transfer medium is faster in said second mode than in said first mode.

17. An image forming apparatus according to any one of claims 14 to 16, wherein there are a plurality of said predetermined image bearing members.

18. An image forming apparatus according to any one of claims 14 to 16, wherein there is only one of said predetermined image bearing member.

19. An image forming apparatus according to claim 18, wherein said image bearing members bear a yellow toner image, a cyan toner image, a magenta toner image, and a black toner image, respectively.

20. An image forming apparatus according to claim 19, wherein said predetermined toner image is a black toner image.

21. An image forming apparatus according to any one of claims 14 to 16, wherein, if said second mode is selected and when the moving speed of said predetermined image bearing member and the moving speed of said transfer medium at a position where a toner image is transferred from said predetermined image bearing member onto said transfer medium are denoted by V1 and V2, respectively, then a relationship shown below holds true:

$$|(V1-V2)/V2|\times 100<0.3.$$

22. An image forming apparatus according to any one of claims 14 to 16, wherein, if said first mode is selected and when the moving speed of each of said image bearing members and the moving speed of said transfer medium at each of the transfer positions where toner images are sequentially transferred from said plurality of image bearing members onto said transfer medium are denoted by V3 and V4, respectively, then a relationship shown below holds true:

$$0.5<|(V3-V4)/V4|\times 100<3.5.$$

23. An image forming apparatus according to any one of claims 14 to 16, wherein said transfer medium is a transfer material borne and conveyed by a transfer material bearing member.

24. An image forming apparatus according to any one of claims 14 to 16, wherein a toner image that has been transferred to said transfer medium is transferred to a transfer material.

25. An image forming apparatus according to any one of claims 14 to 16, further comprising a plurality of pressure applying members that press said transfer medium toward said image bearing members from a counter side to a side, where a toner image is transferred onto said transfer medium, in order to transfer a toner image on each of said image bearing members onto said transfer medium.

26. An image forming apparatus according to claim 25, wherein a voltage is applied to each of said pressure applying members when an image is transferred.

27. An image forming apparatus according to any one of claims 14 to 16, comprising a plurality of units that include said image bearing members and are detachably installed on a main body of said image forming apparatus.

28. An image forming apparatus comprising:

a plurality of image bearing members bearing toner images of a plurality of colors, wherein selection is made between a first mode wherein the toner images of a plurality of colors are sequentially and superimposedly transferred from said image bearing members onto said transfer medium, and a second mode wherein a toner image of a predetermined color is transferred onto said transfer medium only from a predetermined image bearing member among said plurality of image bearing members; and control means for controlling, according to a selected mode, a length of a toner image formed on said predetermined image bearing member in a direction in which said predetermined image bearing member moves.

29. An image forming apparatus according to claim 28, wherein a difference between a moving speed of each of said image bearing members and a moving speed of said transfer medium at each transfer position is smaller in said second mode than in said first mode.

30. An image forming apparatus according to claim 29, wherein the moving speed of each of said image bearing members is substantially equal to the moving speed of said transfer medium in said second mode.

31. An image forming apparatus according to claim 28, wherein, when said second mode is selected, a moving speed of said predetermined image bearing member is different from a moving speed of said transfer medium at a position where the toner image is transferred from said predetermined image bearing member onto said transfer medium, while a moving speed of an image bearing member other than said predetermined image bearing member is virtually equal to the moving speed of said transfer medium at a position where a toner image is transferred onto said transfer medium from the image bearing member other than said predetermined image bearing member.

32. An image forming apparatus according to claim 31, wherein, when said first mode is selected, the moving speed of each of said image bearing members is different from the moving speed of said transfer medium at each transfer position where a toner image is transferred from each of said image bearing members onto said transfer medium.

33. An image forming apparatus according to any one of claims 28 to 32, wherein the moving speed of said transfer medium is faster in said second mode than in said first mode.

34. An image forming apparatus according to any one of claims 28 to 32, wherein there are a plurality of said predetermined image bearing members.

35. An image forming apparatus according to any one of claims 28 to 32, wherein there is only one of said predetermined image bearing member.

36. An image forming apparatus according to claim 35, wherein said image bearing members bear a yellow toner image, a cyan toner image, a magenta toner image, and a black toner image, respectively.

37. An image forming apparatus according to claim 36, wherein said predetermined toner image is a black toner image.

* * * * *

UNITED STATES PATENT AND TRADEMARK OFFICE

CERTIFICATE OF CORRECTION

PATENT NO. : 6,453,139 B2
DATED : September 17, 2002
INVENTOR(S) : Hiroshi Sasame et al.

It is certified that error appears in the above-identified patent and that said Letters Patent is hereby corrected as shown below:

Column 10,
Line 14, "id" should read -- 1d --.

Signed and Sealed this

Twenty-fifth Day of February, 2003

JAMES E. ROGAN
*Director of the United States Patent and Trademark Office*